US006016840A

United States Patent [19]

Popov et al.

[11] Patent Number: 6,016,840

[45] Date of Patent: Jan. 25, 2000

[54] LIQUID/GAS VACUUM EJECTOR DEVICE

[76] Inventors: Serguei A. Popov, H-1213, Maria Kiralyne ut., 54, Budapest, Hungary; Mikhail V. Akimov, 11 Parkovaya St., 9/34-179, Moscow 105554, Russian Federation

[21] Appl. No.: 09/101,893

[22] PCT Filed: Nov. 10, 1997

[86] PCT No.: PCT/RU97/00352

§ 371 Date: Jul. 17, 1998

§ 102(e) Date: Jul. 17, 1998

[87] PCT Pub. No.: WO98/22714

PCT Pub. Date: May 28, 1998

[51] Int. Cl.[7] ..... G05D 11/03

[52] U.S. Cl. ..... 137/888; 417/196

[58] Field of Search ..... 137/888, 889, 137/890, 891, 892, 893, 894, 895; 417/196, 198

[56] References Cited

U.S. PATENT DOCUMENTS

| | | | |
|---|---|---|---|
| 2,582,069 | 1/1952 | Rose . | |
| 3,799,195 | 3/1974 | Hermans | 417/198 X |
| 4,396,355 | 8/1983 | Wilmot et al. | 417/196 X |
| 4,612,926 | 9/1986 | Boiarski et al. | 137/893 X |
| 5,087,175 | 2/1992 | Raixmain et al. | 417/196 |

FOREIGN PATENT DOCUMENTS 2016262 12/1992 Russian Federation .

1276143 6/1972 United Kingdom .

OTHER PUBLICATIONS

K.P. Shumski; "Vacuum Apparatuses and Devices," Book, 1963, pp. 476–477, Publisher: "Mashgiz", Moscow.

E.Y. Sokolov, N.M. Zinger, "Jet Apparatuses," Book, 1970, p. 209 and p. 23, Publisher: "Energia," Moscow.

Certificate of Authorship, SU 1370324 A1, Jun. 3, 1986, Ivano–Frankovsk Institute of Oil & Gas.

Certificate of Authorship, SU 1770615 A1, Nov. 26, 1990, Ivano0Frankovsk Institute of Oil & Gas.

*Primary Examiner*—Stephen M. Hepperle
*Attorney, Agent, or Firm*—Mark A. Oathout

[57] ABSTRACT

This invention relates to the area of jet technology, primarily to liquid/gas ejector devices used for the creation of a vacuum. The technical problem, solved by the invention, is the increase of the coefficient of efficiency of the liquid/gas vacuum ejector device. This problem has been solved by this invention due to the optimization of the process of mixing gas and liquid media. This has been achieved due to the optimization of mixing gas and liquid media in the mixing chamber of the liquid/gas vacuum ejector device, containing an active nozzle (1) and a mixing chamber (2), the area of the minimal section of the latter being 201 to 800 times the area of the minimal section of the active liquid nozzle (1), and the ratio of the distance from the outlet section of the mixing chamber (2) to the outlet section of the active nozzle (1) to the diameter of the minimal section of mixing chamber (2) is in the range from 10 to 300.

4 Claims, 2 Drawing Sheets

LIQUID/GAS VACUUM EJECTOR DEVICE

BACKGROUND OF THE INVENTION

This invention relates to the area of jet technology, primarily to liquid/gas ejector devices used for the creation of vacuum.

From prior level of technology, liquid/gas ejector devices, containing and active nozzle, receiving chamber, mixing chamber, diffuser and jets, delivering active and passive media are known (see, for instance: R. P. Shurnsky "Vacuum apparatuses and devices," M., Mashgiz, 1963, p. 476–477).

The drawback of the known ejector devices is the comparatively low coefficient of efficiency. This narrows down the area of applicability of these devices.

The closest analogy, selected by the authors as the prototype of this invention, is the liquid/gas ejector device, containing an active nozzle and a mixing chamber with diffuser. The optimal ratio of the sizes of the mixing chamber and the active nozzle shall be determined from a calculated expression, depending on the ratio of the drop of pressure in the mixture of media and the active liquid medium (see. for instance, the book of Sokolov E. Ya. et al. "Ejector devices", M., Energiya, 1970, p. 209)

Performed tests proved that the ejector devices described above do not provide for the needs in ejector devices. For instance, in the processing of hydrocarbon raw materials, productivity and depth of vacuum, is characterized by comparatively big energy losses in the process of the mixture of media in the ejector device.

SUMMARY OF THE INVENTION

This invention is aimed at the increase of the coefficient of efficiency of the liquid/gas vacuum ejector device.

This problem has been solved in this invention due to the optimization of the process of mixing gas and liquid media.

In accordance with the invention, the optimization of the process of mixing gas and liquid media is achieved by the liquid/gas vacuum ejector device, containing an active nozzle and a mixing chamber. In the vacuum ejector device, the area of the minimum cross-section of the mixing chamber amounts to 201 to 800 times the area of the minimum cross-section of the active liquid nozzle. Additionally the ratio of the distance between the outlet cross section of the mixing chamber and the outlet cross section of the active nozzle to the diameter of the minimal cross-section of the chamber is in the range of 10 to 300.

The conducted experiments proved considerable influence on the value of the coefficient of efficiency by the ejector component of the device for the mixing of active—liquid and passive—gas media. For this reason the optimization of the size of the mixing chamber and of the size of the ejector device is of great importance. Optimization of these two elements will increase the efficiency of the creation of a vacuum.

The production of the vacuum ejector device with the ratio of the sizes, indicated above, creates a homogenous gas-liquid, at the outlet of the chamber. At this point the processes of condensation and dissolution of the component of gas medium would practically be completed. As such, the energy losses in the process of the mixing of media are minimized. Consequently, the losses of energy related to the impact of the jet of liquid on the walls of the mixing chamber will be reduced, along with the hydraulic losses due to friction.

These features of the device will provide for the achievement of the technical objective set forth—that is, the increase of the coefficient of efficiency of the liquid/gas ejector device.

The following is the detailed description of the invention with an example of its realization.

DETAILED DESCRIPTION OF THE INVENTION

Figure 1:
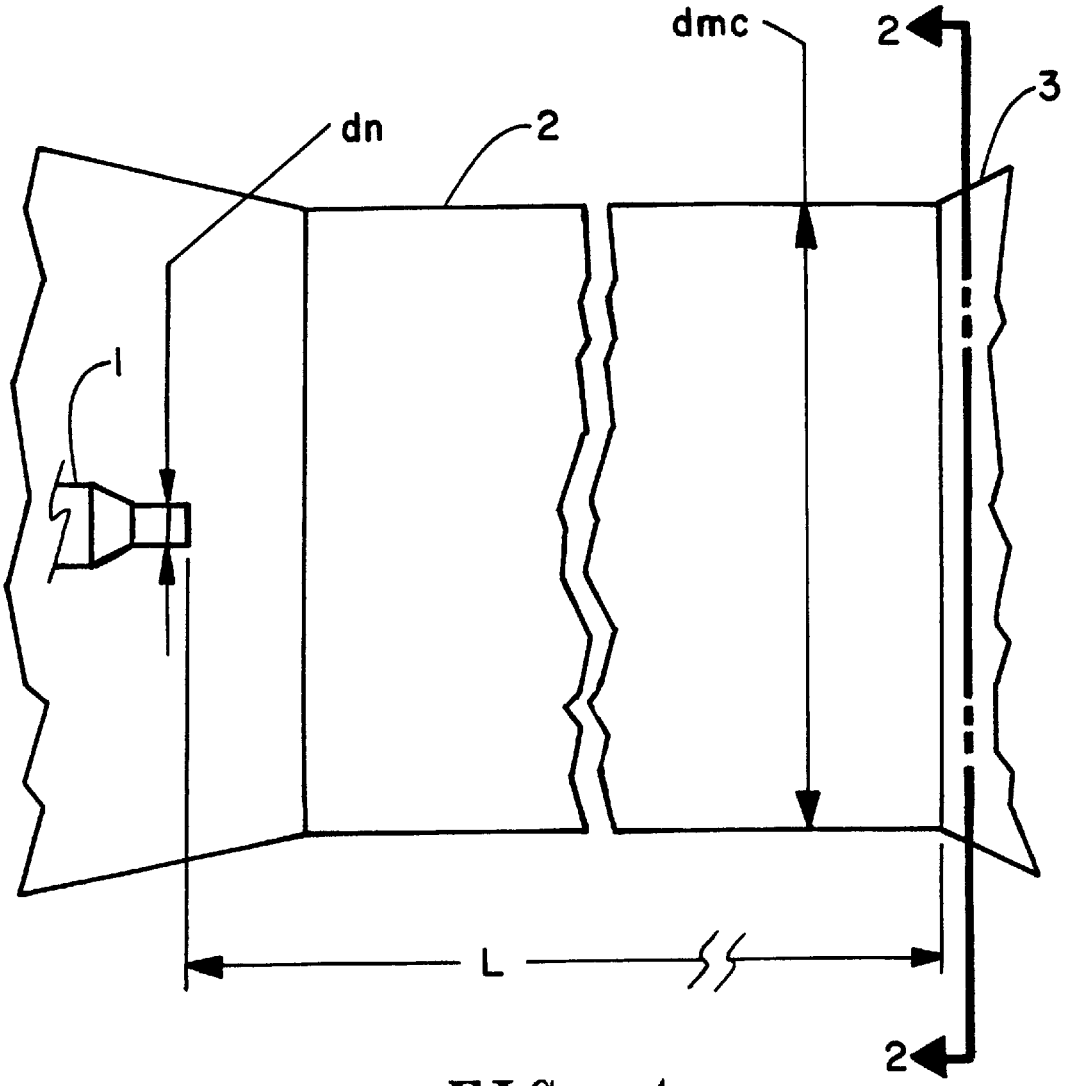
FIG. 1 is a schematic view with a break line representing the described liquid-gas vacuum ejector device.
Figure 2:
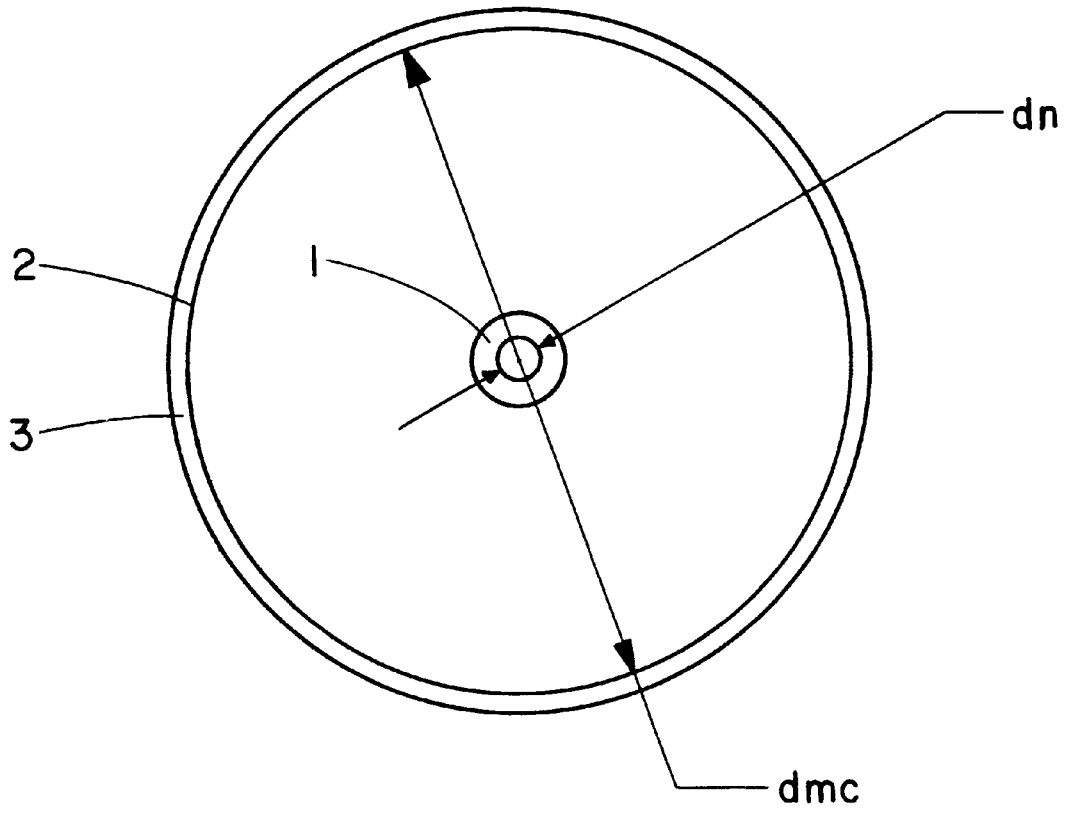
FIG. 2 is a view taken along line 2—2 of FIG. 1

Liquid/gas vacuum ejector device contains an active liquid nozzle 1 mixing chamber 2, and diffuser 3. The area of the minimal cross-section of the mixing chamber 2 (having diameter dmc) represents from 201 to 800 areas of the minimal cross-section of the liquid nozzle 1 (having diameter dn). Stated alternatively, the cross-sectional area of the mixing chamber 2 is 201–800 times larger than the cross-sectional area of liquid nozzle 1 (i.e. $201<dmc^2/dn^2<800$). This differential helps to create the desired mixing chamber characteristics.

Additionally, there is a predetermined distance L between the outlet section of liquid nozzle 1 and the outlet section of chamber 2. The ratio of distance L to the diameter (dmc) of the minimum cross-section of mixing chamber 2 is in the range of 10 to 300. Stated alternatively, the ratio of the distance between the outlet cross-section of the mixing chamber 2 and the outlet cross-section of the active nozzle 1 to the diameter of the minimal cross-section of mixing chamber 2 is from 10 to 300 (i.e. $10 \leqq L/dmc \leqq 300$).

As is well known, the configuration and dimensioning of all these components helps to optimize their particular independent operation. By optimizing their relational dimensions, the overall operation of the device is maximized.

The ejector device works as follows

Active liquid media, flowing from nozzle 1, sweeps the mixed passive gas media into chamber 2. From mixing chamber 2 the mixture of the media proceeds into diffuser 3, where the kinetic energy of the mixture of media is partially transformed into potential energy of pressure.

The invention may be applied in branches of industry, using a vacuum in the production processes, for instance, in chemical, food and a number of other industries.

We claim:

1. A liquid-gas vacuum ejector device, comprising an active liquid nozzle (1) and a mixing chamber (2), where a ratio of the area of the minimal cross-section of the mixing chamber (2) to the area of the minimal cross-section of the active liquid nozzle (1) is within the range of 201 to 800; and where a ratio of the distance from the outlet cross-section of the mixing chamber to the outlet cross-section of the active nozzle (1) to the diameter of the minimal cross-section of the mixing chamber (2) is within the range of 10 to 300.

2. The liquid-gas vacuum ejector device of claim 1 further comprising a diffuser attached to the mixing chamber.

3. The liquid-gas vacuum ejector of claim 1 wherein the mixing chamber is substantially cylindrical.

4. A liquid-gas vacuum ejector device, comprising an active liquid nozzle (1) having an outlet and a minimal cross section and a mixing chamber (2) having an outlet and a minimal cross section, where a ratio of the area of the minimal cross-section of the mixing chamber (2) to the area of the minimal cross-section of the active liquid nozzle (1) is within the range of 201 to 800; and where a ratio of the distance from the outlet cross-section of the mixing chamber to the outlet cross-section of the active nozzle (1) to the diameter of the minimal cross-section of the mixing chamber (2) is within the range of 10 to 300.

* * * * *